US006746590B2

(12) United States Patent
Zhang et al.

(10) Patent No.: US 6,746,590 B2
(45) Date of Patent: Jun. 8, 2004

(54) ULTRASONICALLY-ENHANCED ELECTROPLATING APPARATUS AND METHODS

(75) Inventors: Haiyan Zhang, Woodbury, MN (US); Harlan L. Krinke, Marine-on-St. Croix, MN (US)

(73) Assignee: 3m Innovative Properties Company, St. Paul, MN (US)

( * ) Notice: Subject to any disclaimer, the term of this patent is extended or adjusted under 35 U.S.C. 154(b) by 176 days.

(21) Appl. No.: 09/946,922

(22) Filed: Sep. 5, 2001

(65) Prior Publication Data

US 2003/0042145 A1 Mar. 6, 2003

(51) Int. Cl.[7] ..... C25D 5/20

(52) U.S. Cl. ..... 205/102; 204/198; 204/222; 204/273; 205/123; 205/125; 205/137; 205/146; 205/148

(58) Field of Search ..... 205/102, 123, 205/124, 125, 126, 137, 146, 148; 204/198, 222, 261, 273

(56) References Cited

U.S. PATENT DOCUMENTS

| | | | | |
|---|---|---|---|---|
| 4,647,345 A | * | 3/1987 | Polan | 204/13 |
| 4,842,699 A | | 6/1989 | Hua et al. | |
| 5,185,073 A | * | 2/1993 | Bindra et al. | 205/104 |
| 5,695,621 A | | 12/1997 | Pop et al. | |
| 5,705,230 A | | 1/1998 | Matanabe et al. | |
| 6,368,482 B1 | * | 4/2002 | Oeftering et al. | 205/91 |

FOREIGN PATENT DOCUMENTS

| | | | |
|---|---|---|---|
| GB | 2 313 605 | | 12/1997 |
| JP | 51138538 A | | 11/1976 |
| JP | 62-161985 | * | 7/1987 |
| JP | 1 294 888 A | | 11/1989 |
| WO | WO 98/36107 | | 8/1998 |

OTHER PUBLICATIONS

Schrodt et al. "Enhanced Microelectroforming Technology and Development of an Automated Microelectroforming Workstation," *HARMST '97 Worldwide LIGA Forum*, poster copy, Jun. 20–21, 1997, Madison, WI.

* cited by examiner

*Primary Examiner*—Roy King
*Assistant Examiner*—William T. Leader
(74) *Attorney, Agent, or Firm*—Stephen W. Buckingham

(57) ABSTRACT

Electroplating methods and systems employing ultrasonic energy to enhance electroplating processes. The electroplating methods involve sweeping a plating surface with ultrasonic energy having an area of maximum ultrasonic energy density while simultaneously performing electroplating. The systems include movement apparatus providing relative movement between an ultrasonic energy source and a cathode while the ultrasonic energy source and the cathode are located within a plating tank.

18 Claims, 3 Drawing Sheets

ULTRASONICALLY-ENHANCED ELECTROPLATING APPARATUS AND METHODS

FIELD OF THE INVENTION

The present invention relates to the field of electroplating. More particularly, the present invention provides ultrasonically-enhanced electroplating apparatus and methods.

BACKGROUND

Plating a deep hole, channel, or other high aspect ratio structures, can pose challenging problems. During the plating of high aspect ratio structures, both mass transfer and electrochemical processes may be unfavorable, particularly at the deepest points in the structures. For example, it may be difficult for the bubbles generated during plating to be released from the high aspect ratio structures; metal ions may be depleted rapidly inside the structure and not be replenished properly; and undesirable decomposition products may not be easy to remove from the vicinity of the cathode. Further, the plating process tends to deposit thicker on the mouths of holes or the upper edges of channels, which can have a more significant impact on high aspect ratio plating. All these factors can introduce defects into the plating process.

Various methods have been developed for the high aspect ratio plating. In some LIGA (Lithographie, Galvanoformung and Abformung) processes, high aspect ratio structures have been plated with conventional plating process but with slower plating rate. The plating is usually on relatively small substrates, such as wafers. It is well recognized that traditional plating is both troublesome and time consuming. Plating of a high aspect ratio structure was conducted with a special designed instrument (Ariel G. Schrodt and Nick N. Issaev, "Enhanced Microelectroforming Technology and Development of an Automated Microelectroforming Workstation," HARMST '97 Worldwide LIGA Forum, June, 1997, Madison, Wis., Book of Abstracts). In this method, the part is plated while applying vacuum and thermal gradients. The plating can reach a high speed but can only plate small format with expensive instrument. Another approach to plating high aspect ratio structures involves pulse plating for filling recess of not more than about 1 micron in depth and width (U.S. Pat. No. 5,705,230).

Ultrasonic energy has been used in plating processes, most often as a cleaning aid. U.S. Pat. No. 5,705,230 does, however, use ultrasonic energy while plating a shallow recess. U.S. Pat. No. 4,842,699 describes using ultrasonic energy during via-hole plating to ensure sufficient electrolyte transport in the via-hole. U.S. Pat. No. 5,695,621 discloses the use of a resonating electroplating anode when plating inner surfaces of steam generator tubing. GB 2 313 605 discloses a chromium plating process employing ultrasonic energy to encourage release of bubbles. JP 1 294 888 A describes placing an ultrasonic vibrator inside of a cup for promoting gas bubble release. JP 51138538 discloses plating of a printed circuit board while using ultrasonic energy.

Although ultrasonic energy can enhance the mass transfer and removal of gas bubbles during plating, it can also have negative impacts on plating. In an electroforming process, inappropriate exposure to ultrasonic energy during electroforming can increase the residual stresses in the electroformed parts. The use of ultrasonic energy during electroplating can also cause adhesion problems between the deposited material and substrate, especially when a polymer or other non-conductive substrate is used.

Most electroplating processes are performed in plating tanks containing an electroplating bath. Another problem with the use of ultrasonic energy in a plating tank is that the energy distribution within the tank, especially on the cathode, is not uniform. The ultrasonic transducers are mounted in fixed locations on the side or bottom of the plating tanks, resulting with uneven ultrasonic energy distribution over the cathode because the ultrasonic energy is attenuated with distance. This problem becomes more acute when plating large surfaces because of the increased variations in energy distribution over the surface of the larger parts.

SUMMARY OF THE INVENTION

The present invention provides electroplating methods and systems employing ultrasonic energy to enhance electroplating processes. The electroplating methods involve locating an ultrasonic energy source between the anode and the cathode and sweeping a plating surface with ultrasonic energy having an area of maximum ultrasonic energy density. As a result, each portion of the plating surface receives varying amounts of ultrasonic energy during electroplating, with the maximum ultrasonic energy density being received intermittently by the plating surface.

The apparatus and methods of the present invention may provide particular advantages where the plating surface includes one or move cavities in which electroplating is desired. If the cavities, either holes formed through the cathode or wells formed in a surface of the cathode, have a relatively high aspect ratio, it may be difficult to electroplate the surfaces within the cavities. In some situations, the propagation axis of the ultrasonic energy (i.e., the direction of travel of the ultrasonic energy) may be aligned with the cavities such that the ultrasonic energy reaches throughout the cavities, thereby enhancing plating in the innermost portions of the cavities.

Another potential advantage of the methods and systems of the present invention is a reduction in the amount of ultrasonic energy needed to enhance electroplating. The amount of ultrasonic energy may be reduced because each part of the plating surface is intermittently exposed to the maximum ultrasonic energy density as the ultrasonic energy is swept across the plating surface.

Still another advantage of the present invention is that sweeping of the ultrasonic energy across the plating surface may reduce the problems associated with the use of ultrasonic energy during plating as discussed in the background, e.g., residual stresses, adhesion problems, etc. In addition, the sweeping nature of the ultrasonic energy may improve uniformity in the plated material.

A further advantage of the methods and systems of the present invention is that the ultrasonic energy impinges directly on the plating surface while movement of the ultrasonic energy source reduces or prevents problems associated with shielding or masking that can be caused by locating structures between the anode and the cathode. In those systems in which an ultrasonic energy source is moved between the anode and cathode during electroplating, the intermittent shielding of the cathode by the moving ultrasonic energy source may provide electroplating advantages similar to pulse plating processes (where the current density is intentionally varied).

Although the present invention may provide particular advantages when used in electroforming on high aspect ratio cavities, it may also be advantageous when used in connection with electroplating on any surface, whether or not that surface includes high aspect ratio cavities. Unless explicitly stated otherwise, the present invention is not to be limited to methods and/or systems for electroforming on high aspect ratio cavities.

In one aspect, the present invention provides an electroplating method that includes providing a tank containing a plating solution; providing an anode and a cathode within the plating solution, wherein the cathode has a plating surface; locating an ultrasonic energy source directly between the anode and the plating surface of the cathode; plating the plating surface of the cathode; and sweeping the plating surface with ultrasonic energy emitted by the ultrasonic energy source during the plating, wherein the sweeping includes moving an area of maximum ultrasonic energy density across the plating surface.

In another aspect, the present invention provides a method electroplating that includes providing a tank containing a plating solution; providing an anode and a cathode within the plating solution, wherein the cathode has a plating surface that includes a plurality of cavities, wherein each cavity of the plurality of cavities has a central axis and an aspect ratio of at least about 1:1 or higher; plating the plating surface of the cathode; locating an ultrasonic energy source directly between the anode and the plating surface of the cathode, wherein ultrasonic energy emitted by the ultrasonic energy source has a propagation axis; and sweeping the plating surface with ultrasonic energy emitted from the ultrasonic energy source during the plating.

The sweeping includes moving an area of maximum ultrasonic energy density across the plating surface with an area of maximum ultrasonic energy density; moving the plating surface and the ultrasonic energy source relative to each other while emitting ultrasonic energy from the ultrasonic energy source; and aligning the propagation axis of the ultrasonic energy with the central axis of each cavity of the plurality of cavities.

In another aspect, the present invention provides an electroplating apparatus with a tank having a tank volume; an anode located within the tank volume; a cathode located within the tank volume, wherein the cathode includes a plating surface; an ultrasonic energy source located within the tank volume, the ultrasonic energy source located directly between the anode and the cathode and oriented to emit ultrasonic energy at the plating surface; and movement apparatus providing relative movement between the ultrasonic energy source and the cathode while the ultrasonic energy source and the cathode are located within the tank volume.

These and other features and advantages of the present invention may be described below in connection with various illustrative embodiments of the methods and systems of the present invention.

BRIEF DESCRIPTION OF THE DRAWING

FIG. 7 depicts another electroplating system of the present invention in which sweeping of ultrasonic energy is accomplished by rotational movement, wherein FIG. 7 is taken transverse to the axis of rotation.

DETAILED DESCRIPTION OF ILLUSTRATIVE EMBODIMENTS OF THE INVENTION

Figure 1:
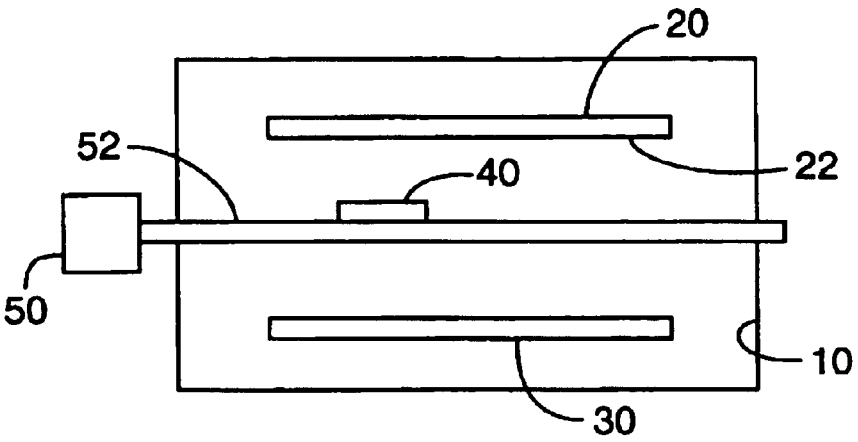
FIG. 1 is a top view of one electroplating system according to the present invention.
Figure 2:
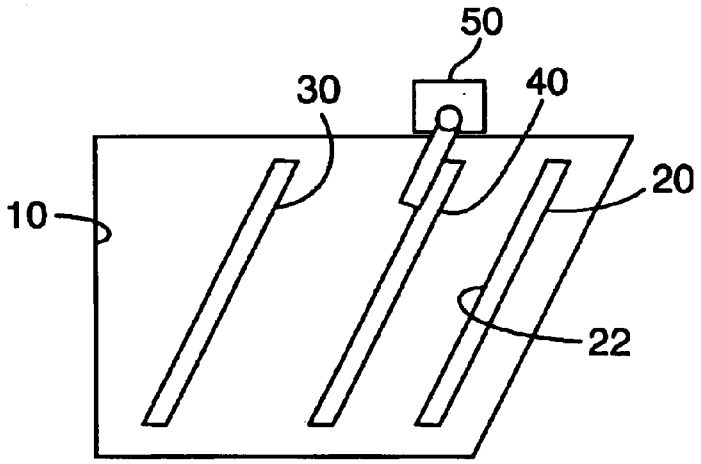
FIG. 2 is a side view of the system of FIG. 1.

One illustrative electroplating system according to the present invention is depicted in FIGS. 1 and 2. It should be understood that this system is illustrative in nature only. Many other systems may be devised that provide for the desired sweeping of an area of maximum ultrasonic energy density across a plating surface in accordance with the present invention.

Although it may be preferred that the "sweeping" or "relative motion" associated with the present invention be continuous (where the velocity of the area of maximum ultrasonic energy density reaches zero only during directional changes), it should be understood that the movement may alternatively be in a step-wise manner, with some stationary dwell time in between discrete moves. It may be preferred, however, that any stationary dwell time occupy no more than about 5% of the overall time during which ultrasonically enhanced plating is being performed.

The depicted system includes a plating tank 10 containing a cathode 20 and an anode 30. An ultrasonic energy source 40 is also located within the plating tank 10, with the ultrasonic energy source 40 being located directly between the cathode 20 and the anode 30. The system also preferably includes a movement apparatus 50 as will be described in more detail below.

Figure 3:
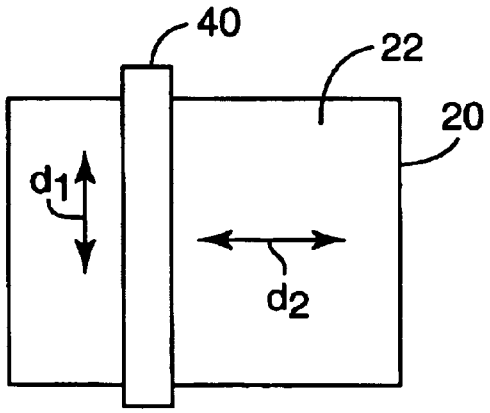
FIG. 3 is a front view of the system of FIG. 1 with the anode 30 removed.

FIG. 1 depicts the top of the plating tank 10 along the top edges of the cathode 20 and the anode 30. The top end of the ultrasonic energy source 40 is also seen in this view, along with the top edges of the sidewalls of the plating tank 10. FIG. 2 is a side view of the system depicting the side edges of the cathode 20, anode 30 and preferred ultrasonic energy source 40. FIG. 3 is a view of the front of the system with the plating tank 10 and the anode 30 removed to expose the ultrasonic energy source 40 and the cathode 20.

A movement apparatus 50 is also depicted in FIGS. 1–3. As described in more detail below, the movement apparatus 50 is used to move the ultrasonic energy source 40 across the cathode 20. Most, if not all, of the movement apparatus 50 may preferably be located outside of any plating solution within the plating tank 10.

The movement apparatus 50 may preferably be capable of moving the ultrasonic energy source 40 in reciprocal motion back and forth across the plating surface 22 of the cathode 20 during electroplating. Any mechanism or combination of mechanisms known to those of skill in the art may be used to provide the desired reciprocal motion. Examples include, but are not limited to, cam and follower mechanisms, ball reverser mechanisms, etc.

Furthermore, although the movement apparatus 50 is depicted as moving the ultrasonic energy source 40 while the cathode 20 remains stationary, it should be understood that other systems may be provided in which the ultrasonic energy source 40 remains stationary while the cathode 20 moves. In yet another alternative, both the cathode 20 and the ultrasonic energy source 40 may move (at the same or different times).

The plating tank 10 may be of any suitable shape and/or configuration. It may, for example, have a generally rectangular top opening and three generally vertical sidewalls extending to the bottom. The fourth sidewall may conveniently be angled relative to vertical to improve plating of relatively flat substrates attached to the cathode structure 20 which then lies against the sloping sidewall. Such plating tank constructions are known in the art and will not be described further herein.

Appropriate pumps and fluid reservoirs may be attached to the plating tank 10 to provide any desired circulation of the electroplating solutions. In some instances, fresh electroplating solutions may be metered into the tank 10 if desired while spent solution is removed from the tank 10 during plating.

The cathode 20 is located within the plating tank 10 such that it is submerged within the plating solution during plating. The cathode 20 includes or defines a plating surface 22 on which plating is preferentially performed. The cathode 20 will typically be provided in the form of a substrate or object that can be removed from the system after electroplating is complete.

When the cathodes to be treated in methods according to the present invention are constructed of a material or materials that are not sufficiently electrically conductive for proper electroplating, it may be preferred to provide a thin electrically-conductive layer on at least the target surface 22. That layer may be deposited or formed by any suitable technique, e.g., sputtering, chemical vapor deposition, mirror reaction, electroless plating, etc.

An anode 30 is also located within the tank 10 in such a manner that the anode 30 is submerged within the plating solution during plating. The anode 30 may, for example, be provided in the form of metal plates or baskets containing metal balls or pellets. In many cases, anode bags may also be used to reduce or prevent the leakage of anode sludge into the plating bath. Further, an anode shield may also be used to improve current distribution.

As described above, the components of the system are largely conventional in shape and size. In accordance with the present invention, however, the system also includes an ultrasonic energy source 40 located directly between the cathode 20 and the anode 30. As used herein, "located directly between" means that the ultrasonic energy source 40 is interposed between the cathode 20 and anode 30 such that a line of sight projection of the anode 30 onto the cathode 20 would be partially obscured by the ultrasonic energy source 40.

In a typical electroplating system, obstructions located directly between the cathode 20 and anode 30 can result in uneven plating because of shadowing and other effects. As a result, known electroplating systems and methods avoid introducing obstructions between the cathode 20 and anode 30. In contrast, the present invention may locate the ultrasonic energy source 40 directly between the cathode 20 and anode 30. The negative effects of obstructing the path between the cathode 20 and anode 30 are, however, reduced by moving the ultrasonic energy source 40 during plating such that any shielding of the cathode 20 by the ultrasonic energy source 40 does not result in uneven plating.

The ultrasonic energy source 40 is mounted within the system such that ultrasonic energy emitted by the ultrasonic energy source 40 is directed at the plating surface 22 of the cathode 20. The ultrasonic energy impinging on the plating surface 22 may preferably, but not necessarily, be distributed relatively uniformly over the plating surface 22 along the direction corresponding to the direction along which the ultrasonic energy source 40 is elongated, e.g., $d_1$ in FIG. 3. To accomplish that goal, the ultrasonic energy source 40 may preferably be elongated (e.g., in the form of a bar, beam, etc.) such that it spans the plating surface 22 of the cathode 20 along one direction ($d_1$). The ultrasonic energy source 40 may be provided in the form of a single elongated transducer, or it may be provided as an array of transducers mounted along an axis.

Although the ultrasonic energy source 40 preferably spans the plating surface 22 of the cathode 20 in one direction, e.g., $d_1$, it may preferably be narrower than the plating surface 22 of the cathode along a second direction, e.g., $d_2$ in FIG. 3. At a minimum, the second direction is not parallel to the first direction. It may be preferred that the second direction is orthogonal to the first direction as seen in, e.g., FIG. 2.

Figure 4:
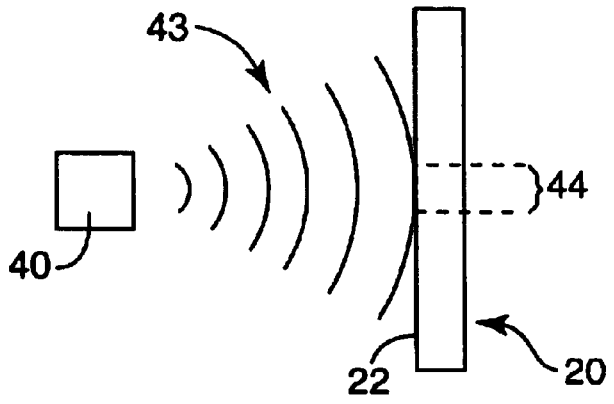
FIG. 4 is a view of an alternate electroplating system.

Referring to FIG. 4 in which the ultrasonic energy source 40 is viewed along one end, the ultrasonic energy source 40 will typically emit ultrasonic energy as waveforms 43 in the direction of the plating surface 22. As those waveforms impinge on the plating surface 22, they will define an area of maximum ultrasonic energy density that will typically correspond to the shortest distance between the ultrasonic energy source 40 and the plating surface 22. FIG. 4 includes an exemplary area of maximum ultrasonic energy density 44.

Theoretically the ultrasonic energy density experienced at the plating surface 22 may take on a profile in which only a very small portion of the plating surface 22 experiences the absolute maximum energy density, i.e., the highest ultrasonic energy density experienced at the plating surface at any given time. For the purposes of the present invention, however, the "area of maximum ultrasonic energy density" may be defined as, for example, the area of the plating surface 22 that experiences at least about 95% or more of the absolute maximum energy density.

Figure 5:
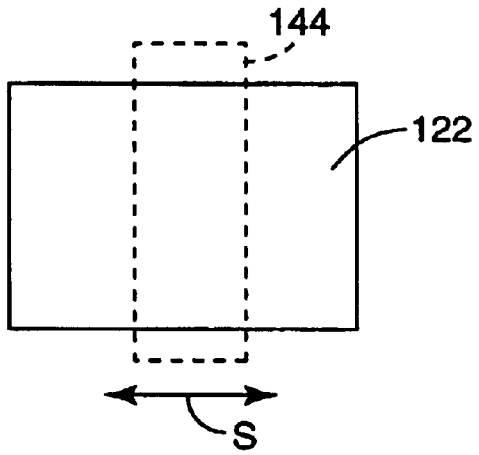
FIG. 5 is a schematic depiction of a plating surface on which an area of maximum ultrasonic energy density is indicated by broken lines.

FIG. 5 is a schematic depiction of a plating surface 122 on which an area of maximum ultrasonic energy density 144 is indicated by broken lines. In accordance with the present invention, the area 144 sweeps across the plating surface 122 in the direction of double-headed arrow S at least two times, such that any selected point on the plating surface 122 is exposed to the maximum ultrasonic energy density at least, e.g., twice during plating.

Figure 6:
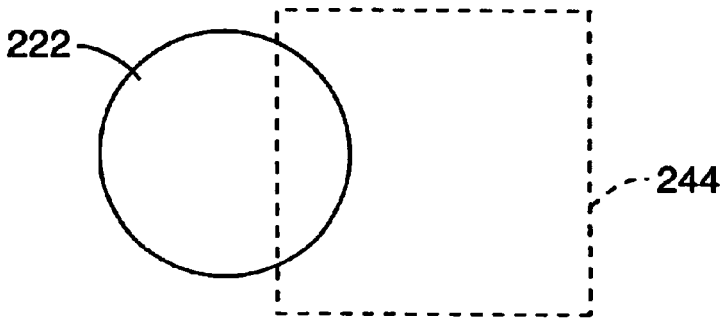
FIG. 6 depicts a variation of FIG. 5 in which the area of maximum ultrasonic energy density is larger than the plating surface.

Although the system or method depicted in FIG. 5 shows that the area of maximum ultrasonic energy density 144 is smaller in at least one dimension than the plating surface 122, FIG. 6 depicts another variation in which the area of maximum ultrasonic energy density 244 is larger in all dimensions than the plating surface 222. As a result, sweeping of the area 244 in accordance with the methods of the present invention will require movement of the area 244 relative to the plating surface 222 that results in location of a portion of the plating surface 222 outside of the area 244 as seen, e.g., in FIG. 6.

Figure 7:
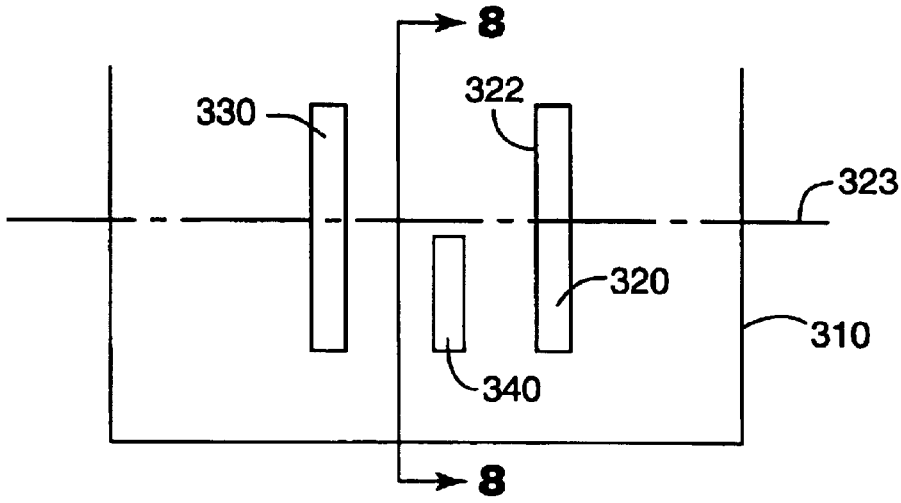
Figure 8:
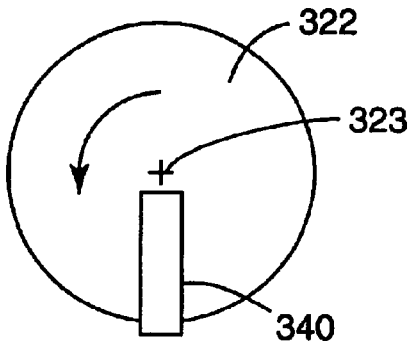
FIG. 8 is a view of the system of FIG. 7 taken along the line 8—8 in FIG. 7.

FIGS. 7 & 8 depict another variation on the systems and methods of the present invention in which the plating surface 322 on cathode 320 is rotated about an axis of rotation 323 while located within a plating tank 310. An ultrasonic energy source 340 is located within the tank 310 between the anode 330 and the plating surface 322. Rotation of the cathode about the axis 323 (by any suitable rotating mechanism) provides the sweeping of an area of maximum ultrasonic energy density over the plating surface 322. In accordance with the methods of the present invention, it will typically be preferred that the cathode 320 be rotated such that each portion of the plating surface 322 passes in front of the ultrasonic energy source 340 at least twice to provide the repetitive sweeping of ultrasonic energy according to the methods of the present invention. Although movement of the cathode 320 is depicted, it will be understood that, alternatively, the ultrasonic energy source 340 could be moved while the cathode remained stationary, or, in another alternative, both the cathode 320 and the ultrasonic energy source 340 could be moved at the same or different times.

Figure 9:
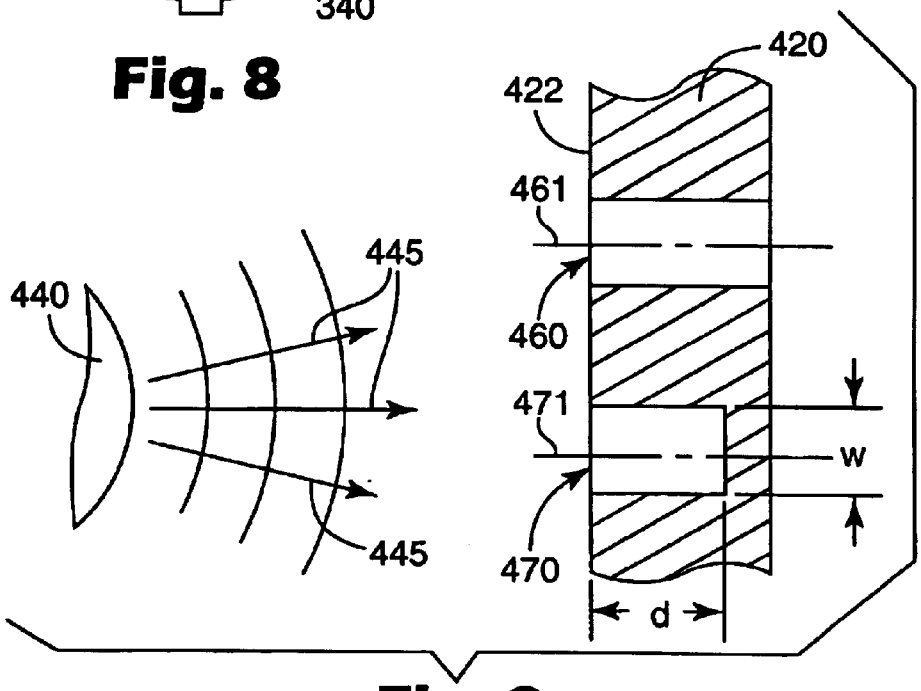
FIG. 9 depicts relationships between ultrasonic energy propagation axes and central axes of cavities in a plating surface.

FIG. 9 depicts another optional feature of the methods and apparatus according to the present invention. A plating surface 422 is provided in a cathode 420 (only a portion of which is shown in FIG. 9). The plating surface 422 includes one cavity in the form of a through-hole 460, i.e., a void formed completely through the cathode 420. Another cavity is also seen in FIG. 9 in the form of a well 470 that is not formed completely through the cathode 420 as is through-hole 460.

Each of the cavities, i.e., through-hole 460 and well 470, defines a central axis 461 and 471 (respectively) that extends from the cavity. Further, each cavity also defines an aspect ratio that is a ratio of the depth of the cavity along the central axis to the width of the cavity (where the width is measured transverse to the depth of the cavity at the midpoint of the depth of the cavity). The cavities formed in plating surfaces of cathodes of the present invention may have a high aspect ratio (d:w), i.e., an aspect ratio of about 1:1 or higher.

For the purposes of the present invention, the depth of the through-hole 460 may typically be defined as the thickness of the cathode 420. Although the axes 461 and 471 are depicted as normal to the generally flat plating surface 422, it should be understood that in some instances, cavities may be provided with central axes that are not normal to the plating surface 422, i.e., the central axes may be canted relative to normal.

The ultrasonic energy source 440 of FIG. 9 is depicted as emitting ultrasonic energy in waveforms that define axes of propagation 445 emanating from ultrasonic energy source 440. Although only a few propagation axes are depicted in FIG. 9, it will be understood that a multitude of propagation axes exist and those shown are exemplary in nature only.

It may be preferred in some aspect of the present invention that at least one axis of propagation of the ultrasonic energy emitted by the ultrasonic energy source 440 be aligned with the central axis of each cavity in the cathode 420. Alignment of the propagation axes with the central axes of the cavities may enhance plating within the cavities by enhancing the delivery of ultrasonic energy to the deepest portions of the cavities.

In the methods according to the present invention, the power level at which the ultrasonic energy source is operated may vary based on a variety of factors including, but not limited to, the materials being plated on the cathode, the size of the cathode, the thickness of the desired plating, the aspect ratio of any cavities in the plating surface, whether the plating is to be conformal or not, the composition of the plating bath, the current density between the anode and the cathode, etc.

Because of the sweeping nature of the ultrasonic energy, the energy density of the ultrasonic energy may be significantly lower than that typically used in, e.g., cleaning processes or conventional ultrasonically-enhanced plating processes (in which the ultrasonic energy is not swept over the plating surface). For example, the energy density used during plating may be only about 10% of the energy density used during cleaning because there is no need to cavitate the plating solution in the tank.

Although the present invention is directed at methods of ultrasonically-enhanced electroplating, it may be preferred to provide ultrasonic energy within the plating tank for only a portion of the time during which electroplating is occurring. In one method, for example, it may be desirable to sweep ultrasonic energy over the plating surface only after an initial period of electroplating in the absence of ultrasonic energy. In another method, it may be desirable to electroplate while sweeping ultrasonic energy over the plating surface first, followed by discontinuing the ultrasonic energy while continuing to electroplate in the absence of ultrasonic energy. In either method, the plating current density may be the same during all stages, or it may be varied as desired.

In still another method, it may be preferred to perform some initial electroplating in the absence of any ultrasonic energy, followed by plating while sweeping ultrasonic energy over the plating surface, and then discontinuing delivery of the ultrasonic energy to the plating surface while continuing to electroplate the plating surface. As above, the plating current density may be the same during all stages, or the plating current density may be varied as desired.

EXAMPLE

The following example is provided to enhance understanding of the present invention. It is not intended to limit the scope of the invention.

A plating tank with a solution volume of 65 gallons (246 liters) is provided. A cathode was placed in the tank and oriented at a 45° angle relative to horizontal, with the target surface facing upward. The cathode was a planar polyimide substrate mounted on glass, including cavities in the plating surface. The aspect ratio of the cavities was about 28:1. The plating surface was seeded with an electrically conductive layer of silver before electroplating by mirror reaction.

An anode was provided in the form of nickel pellets in a titanium basket. The pellets were manufactured by International Nickel Company. Anode bags were placed about the anode. The anode was mounted substantially parallel with the cathode.

An ultrasonic transducer was located in the tank directly between the target surface of the cathode and the anode, with the ultrasonic transducer facing the target surface of the cathode. The ultrasonic transducer was a Model N-1000 (NEPTUNE Series) from CAE Ultrasonics (Jamestown, N.Y.), with an average power of 350 W (350 J/s) and frequency of 40 kHz.

The ultrasonic transducer was mounted on a reciprocating movement apparatus. The movement apparatus was located above the plating tank and moved the ultrasonic transducer back and forth across the plating surface of the cathode during the plating process.

The plating solution was an aqueous bath including nickel sulfamate 500 g/l, boric acid 30 g/l and small amount of surfactant (Barrett Snap L from McDermid) to adjust the surface tension to 29 dyn/cm$^2$ (as measured using a Fisher Scientific SURFACE TENSIOMAT 21). The temperature of plating solution was 135° F. (57° Celsius). The plating solution was recirculated within the plating tank at a rate of about ten times per hour during plating.

With all components in place, electroplating was begun with a current density of 1 ASF (0.108 A/dm$^2$) in the absence of ultrasonic energy for one hour, followed by electroplating at the same current density while sweeping ultrasonic energy across the plating surface for 24 hours, after which delivery of the ultrasonic energy was discontinued. Electroplating was, however, continued in the absence of the ultrasonic energy for 24 hours at a current density of 15 ASF (1.62 $A/dm^2$).

During electroplating, the ultrasonic transducer was operated at a power level of about 35 W (35 J/s) during electroplating. The ultrasonic transducer was moved during electroplating in reciprocal motion back and forth across the plating surface of the cathode, such that the ultrasonic transducer completed each pass in one direction over the plating surface about every 30 seconds.

According to this process, the plating surface was electroplated with nickel, providing a high-quality, solid structure, low stress, good adhesion and uniform deposition.

The preceding specific embodiments are illustrative of the practice of the invention. This invention may be suitably practiced in the absence of any element or item not specifically described in this document. The complete disclosures of all patents, patent applications, and publications are incorporated into this document by reference as if individually incorporated.

Various modifications and alterations of this invention will become apparent to those skilled in the art without departing from the scope of this invention. For example, although the systems and methods are depicted as being used with only one ultrasonic energy source, two or more ultrasonic energy sources could be used to provide ultrasonic energy on the target surface during plating. In another example, a curved or otherwise non-planar target surface could be plated. It should be understood that this invention is not to be unduly limited to illustrative embodiments set forth herein.

What is claimed is:

1. A electroplating method comprising:

providing a tank comprising a plating solution;

providing an anode and a cathode within the plating solution, wherein the cathode comprises a plating surface and wherein the plating surface comprises at least one cavity comprising a central axis;

locating an ultrasonic energy source directly between the anode and the plating surface of the cathode;

plating the plating surface of the cathode; and sweeping the plating surface with ultrasonic energy emitted by the ultrasonic energy source during the plating, wherein the sweeping comprises moving an area of maximum ultrasonic energy density across the plating surface, wherein the ultrasonic energy comprises a propagation axis, and wherein the method comprises aligning the propagation axis with the central axis.

2. A method according to claim 1, wherein the at least one cavity comprises an aspect ratio of at least about 1:1 or higher.

3. A method according to claim 1, wherein the at least one cavity comprises a hole formed through the cathode.

4. A method according to claim 1, wherein the at least one cavity comprises a well.

5. An electroplating method comprising:

providing a tank comprising a plating solution;

providing an anode and a cathode within the plating solution, wherein the cathode comprises a plating surface;

locating an ultrasonic energy source direct between the anode and the plating surface of the cathode;

plating the plating surface of the cathode; and sweeping the plating surface with ultrasonic energy emitted by the ultrasonic energy source during the plating, wherein the sweeping comprises moving an area of maximum ultrasonic energy density across the plating surface;

wherein plating the plating surface comprises plating at a first current density in the absence of ultrasonic energy emitted by the ultrasonic energy source, followed by plating at a second current density while sweeping the plating surface with ultrasonic energy, and further wherein the first current density is not equal to the second current density.

6. An electroplating method comprising:

providing a tank comprising a plating solution;

providing an anode and a cathode within the plating solution, wherein the cathode comprises a plating surface;

locating an ultrasonic energy source directly between the anode and the plating surface of the cathode;

plating the plating surface of the cathode; and sweeping the plating surface with ultrasonic energy emitted by the ultrasonic energy source during the plating, wherein the sweeping comprises moving an area of maximum ultrasonic energy density across the plating surface;

wherein plating the plating surface comprises plating at a first current density while sweeping the plating surface with ultrasonic energy, followed by plating at a second current density in the absence of ultrasonic energy emitted by the ultrasonic energy source, and further wherein the first current density is not equal to the second current density.

7. An electroplating method comprising:

providing a tank comprising a plating solution;

providing an anode and a cathode within the plating solution, wherein the cathode comprises a plating surface;

locating an ultrasonic energy source directly between the anode and the plating surface of the cathode;

plating the plating surface of the cathode; and sweeping the plating surface with ultrasonic energy emitted by the ultrasonic energy source during the plating, wherein the sweeping comprises moving an area of maximum ultrasonic energy density across the plating surface;

wherein plating the plating surface comprises:

plating at a first current density in the absence of ultrasonic energy emitted by the ultrasonic energy source;

plating at a second current density while sweeping the plating surface with ultrasonic energy;

discontinuing delivery of the ultrasonic energy to the plating surface;

plating at a third current density after discontinuing delivery of the ultrasonic energy to the plating surface;

and further wherein the first current density, the second current density, and the third current density are all different.

8. An electroplating method comprising:

providing a tank comprising a plating solution;

providing an anode and a cathode within the plating solution, wherein the cathode comprises a plating surface that comprises a plurality of cavities, wherein each cavity of the plurality of cavities comprises a central axis and an aspect ratio of at least about 1:1 or higher, plating the plating surface of the cathode;

locating an ultrasonic energy source directly between the anode and the plating surface of the cathode, wherein ultrasonic energy emitted by the ultrasonic energy source comprises a propagation axis;

sweeping the plating surface with ultrasonic energy emitted from the ultrasonic energy source during the plating, wherein the sweeping comprises moving an area of maximum ultrasonic energy density across the plating surface with an area of maximum ultrasonic energy density;

wherein sweeping the plating surface with ultrasonic energy comprises moving the plating surface and the ultrasonic energy source relative to each other while emitting ultrasonic energy from the ultrasonic energy source;

and wherein the sweeping comprises aligning the propagation axis of the ultrasonic energy with the ventral axis of each cavity of the plurality of cavities.

9. A method according to claim 8, wherein plating the plating surface comprises plating at a first current density in the absence of ultrasonic energy emitted by the ultrasonic energy source, followed by plating at a second current density while sweeping the plating surface with ultrasonic energy.

10. A method according to claim 9, wherein the first current density is not equal to the second current density.

11. A method according to claim 8, wherein plating the plating surface comprises plating at a first current density while sweeping the plating surface with ultrasonic energy, followed by plating at a second current density in the absence of ultrasonic energy emitted by the ultrasonic energy source.

12. A method according to claim 11, wherein the first current density is not equal to the second current density.

13. A method according to claim 8, wherein plating the plating surface comprises:

plating at a first current density in the absence of ultrasonic energy emitted by the ultrasonic energy source;

plating at a second current density while sweeping the plating surface with ultrasonic energy;

discontinuing delivery of the ultrasonic energy to the plating surface;

plating at a third current density after discontinuing delivery of the ultrasonic energy to the plating surface.

14. A method according to claim 13, wherein the first current density, the second current density, and the third current density are all different.

15. An electroplating apparatus comprising:

a tank comprising a tank volume;

an anode located within the tank volume;

a cathode located within the tank volume, wherein the cathode comprises a plating surface;

an ultrasonic energy source located within the tank volume, the ultrasonic energy source located directly between the anode and the cathode and oriented to emit ultrasonic energy at the plating surface; and movement apparatus providing relative movement between the ultrasonic energy source and the cathode while the ultrasonic energy source and the cathode are located within the tank wherein the movement apparatus comprises a reciprocating movement apparatus capable of moving the ultrasonic energy source and the cathode relative to each other in a reciprocal manner.

16. An electroplating apparatus comprising:

a tank comprising a tank volume:

an anode located within the tank volume:

a cathode located within the tank volume, wherein the cathode comprises a plating surface;

an ultrasonic energy source located within the tank volume, the ultrasonic energy source located directly between the anode and the cathode and oriented to emit ultrasonic energy at the plating surface; and movement apparatus providing relative movement between the ultrasonic energy source and the cathode while the ultrasonic energy source and the cathode are located within the tank volume:

wherein the movement apparatus comprises a reciprocating movement apparatus operably attached to the ultrasonic energy source to reciprocally move the ultrasonic energy source within the tank volume.

17. An electroplating apparatus comprising:

a tank comprising a tank volume;

an anode located within the tank volume;

a cathode located within the tank volume, wherein the cathode comprises a plating surface;

an ultrasonic energy source located within the tank volume, the ultrasonic energy source located directly between the anode and the cathode and oriented to emit ultrasonic energy at the plating surface; and movement apparatus providing relative movement between the ultrasonic energy source and the cathode while the ultrasonic energy source and the cathode are located within the tank volume;

wherein the movement apparatus comprises a reciprocating movement apparatus operably attached to the cathode to reciprocally move the cathode within the tank volume.

18. An electroplating apparatus comprising:

a tank comprising a tank volume;

an anode located within the tank volume;

a cathode located within the tank volume, wherein the cathode comprising plating surface;

an ultrasonic energy source located within the tank volume, the ultrasonic energy source located directly between the anode and the cathode and oriented to emit ultrasonic energy at the plating surface; and movement apparatus providing relative movement between the ultrasonic energy source and the cathode while the ultrasonic energy source and the cathode are located within the tank volume;

wherein the movement apparatus comprises rotating movement apparatus capable of rotating the ultrasonic energy source about an axis of rotation.

* * * * *

UNITED STATES PATENT AND TRADEMARK OFFICE

CERTIFICATE OF CORRECTION

PATENT NO. : 6,746,590 B2
DATED : June 8, 2004
INVENTOR(S) : Zhang, Haiyan

It is certified that error appears in the above-identified patent and that said Letters Patent is hereby corrected as shown below:

Column 9,
Line 37, delete “A” and insert in place thereof -- An --.
Line 60, delete “well” insert -- formed in the plating surface --.
Line 66, delete “direct” and insert in place thereof -- directly --.

Column 11,
Line 3, delete “,” and insert in place thereof -- ; --.
Line 22, delete “ventral” and insert in place thereof -- central --.

Column 12,
Line 4, after “tank” insert -- volume; --.
Line 10, delete “:” and insert in place thereof -- ; --.
Line 11, delete “:” and insert in place thereof -- ; --.
Line 22, delete “:” and insert in place thereof -- ; --.
Line 49, delete “comprising” and insert in place thereof -- comprises a --.

Signed and Sealed this

Tenth Day of May, 2005

JON W. DUDAS
*Director of the United States Patent and Trademark Office*